US009737928B2

(12) United States Patent
Lemarchand et al.

(10) Patent No.: US 9,737,928 B2
(45) Date of Patent: Aug. 22, 2017

(54) NECK-DOWN FEEDER

(71) Applicant: Foseco International Limited, Derbyshire (GB)

(72) Inventors: Sylvain Lemarchand, Esbly (FR); Philippe Leclerc, Pavilly (FR)

(73) Assignee: FOSECO INTERNATIONAL LIMITED, Derbyshire (GB)

( * ) Notice: Subject to any disclaimer, the term of this patent is extended or adjusted under 35 U.S.C. 154(b) by 489 days.

(21) Appl. No.: 14/374,644

(22) PCT Filed: Apr. 30, 2013

(86) PCT No.: PCT/GB2013/051103

§ 371 (c)(1),
(2) Date: Jul. 25, 2014

(87) PCT Pub. No.: WO2013/164596

PCT Pub. Date: Nov. 7, 2013

(65) Prior Publication Data

US 2015/0034801 A1 Feb. 5, 2015

(30) Foreign Application Priority Data

Apr. 30, 2012 (EP) ..... 12250104

(51) Int. Cl.
*B22C 9/08* (2006.01)

(52) U.S. Cl.
CPC ..... *B22C 9/088* (2013.01); *B22C 9/084* (2013.01)

(58) Field of Classification Search
CPC ..... B22C 9/084; B22C 9/088
See application file for complete search history.

(56) References Cited

U.S. PATENT DOCUMENTS 7,503,999 B2 * 3/2009 Tsuura ..... B22C 9/082 138/154

FOREIGN PATENT DOCUMENTS

| | | | |
|---|---|---|---|
| CN | 202162337 | U | 3/2012 |
| CN | 202377488 | U | 8/2012 |
| CN | 202571176 | U | 12/2012 |
| DE | 20 2007 005575 | U1 | 6/2007 |
| DE | 20 2007 005 575 | U1 | 7/2007 |
| EP | 1 184 104 | A1 | 3/2002 |
| EP | 1 184 104 | B1 | 12/2004 |
| EP | 1 775 045 | A2 | 4/2007 |
| WO | WO 2005/051568 | A1 | 6/2005 |

OTHER PUBLICATIONS

Chinese Examination Report dated Sep. 6, 2015 issued in Chinese PCT National Phase Patent Application No. 201380022559.8, based on PCT/GB2013/051103, filed Apr. 30, 2013 (5 pgs).

(Continued)

*Primary Examiner* — James Sanders
(74) *Attorney, Agent, or Firm* — Nixon & Vanderhye, P.C.

(57) ABSTRACT

The invention provides a neck-down feeder of unitary construction for use in metal casting. The feeder comprises a body portion integrally formed at a first end thereof with a tapered base portion for mounting on a mold pattern. The body portion and the base portion are defined by a continuous sidewall having one or more regions of weakness arranged such that the feeder is breakable in use whereby at least a part of the base portion detaches from the body portion and is received therein.

14 Claims, 5 Drawing Sheets

(56) References Cited

OTHER PUBLICATIONS

European Extended Search Report, Application No. 12250104.2, dated Oct. 12, 2012, 6 pgs.
European Office Action, Application No. 12250104.2, dated Feb. 19, 2013, 5 pgs.
Japanese Office Action dated Jan. 24, 2017, Issued in co-pending Japanese Patent Application No. 2015-509489.

* cited by examiner

NECK-DOWN FEEDER

This application is the U.S. national phase of International Application No. PCT/GB2013/051103 filed 30 Apr. 2013 which designated the U.S. and claims priority to European Patent Application No. 12250104.2, filed 30 Apr. 2012, the entire contents of each of which are hereby incorporated by reference.

The present invention relates to a neck-down feeder for use in metal casting operations utilising casting moulds.

BACKGROUND OF THE INVENTION

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould during mould formation. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting. It is important that metal in the feeder sleeve cavity remains molten longer than the metal in the mould cavity, so feeder sleeves are made to be highly insulating or more usually exothermic, so that upon contact with the molten metal additional heat is generated to delay solidification.

After solidification and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the mould (the process commonly known as "knock off"). A small footprint on the casting is also desirable to allow the positioning of feeder sleeves in areas of the casting where access may be restricted by adjacent features.

Feeder sleeves may be applied directly onto the surface of the mould cavity, or they may used in conjunction with a breaker core. A breaker core is simply a disc of refractory material (typically a resin bonded sand core or a ceramic core or a core of feeder sleeve material) with a hole in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the mould.

Moulding sand can be classified into two main categories; chemical bonded (based on either organic or inorganic binders) or clay-bonded. Chemically bonded moulding sand binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting. Clay-bonded moulding systems use clay and water as the binder and can be used in the "green" or undried state and are commonly referred to as greensand. Greensand mixtures do not flow readily or move easily under compression forces alone and therefore to compact the greensand around the pattern and give the mould sufficient strength properties, a variety of combinations of jolting, vibrating, squeezing and ramming are applied to produce uniform strength moulds at high productivity.

Moulding practices are well known and are described for examples in chapters 12 and 13 of Foseco Ferrous Foundryman's Handbook (ISBN 075064284 X). A typical process known as the no-bake or cold-setting process is to mix the sand with a liquid resin or silicate binder together with an appropriate catalyst, usually in a continuous mixer. The mixed sand is then compacted around the pattern by a combination of vibration and ramming and then allowed to stand, during which time the catalyst begins to react with the binder resulting in hardening of the sand mixture. When the mould has reached a handleable strength, it is removed from the pattern and continues to harden until the chemical reaction is complete.

When feeder sleeves are employed, they are placed on the pattern plate and the mixed sand applied around them. Typically the mould with the pattern plate and feeder sleeve(s) is part filled with mixed sand which is compacted onto the pattern plate and around the feeder sleeve(s). Further mixed sand is quickly added to fill the mould and the sand compacted, allowed to harden and then removed from the pattern plate. Problems often arise due to poor or insufficient compaction of sand around the base of the feeder sleeve that can lead to poor surface finish and defects in the casting. This is a particular concern when using neck down or tapered sleeves that lead to undercuts between the pattern plate and under the tapered sidewall (neck) where it is difficult to compact the sand consistently and to the required level.

The solution offered in EP-A-1184104 is a two-part feeder sleeve. During the moulding operation, pressure is applied to the top of the sleeve and one element of the sleeve part telescopes into the other. One of the sleeve parts is always in contact with the pattern plate, and the outer upper sleeve element moves towards the pattern plate and compresses the moulding sand underneath it and adjacent to the pattern plate. However, a problem arises from the tabs or flanges which are required to maintain the initial spacing of the two mould (sleeve) parts. During moulding, these small tabs break off (thereby permitting the telescoping action to take place) and simply fall into the moulding sand. Over a period of time, these pieces will build up in the moulding sand. The problem is particularly acute when the pieces are made from exothermic material. Moisture from the sand can potentially react with the exothermic material (e.g. metallic aluminium) creating the potential for small explosive defects.

SUMMARY OF THE INVENTION

It is an object of the present invention to provide an improved feeder which can be used in a cast moulding operation which mitigates one or more of the problems associated with known feeders.

In accordance with a first aspect of the present invention, there is provided a neck-down feeder of unitary construction for use in metal casting, comprising a body portion integrally formed at a first end thereof with a tapered base portion for mounting on a mould pattern, the body portion and the base portion being defined by a continuous sidewall having one or more regions of reduced thickness arranged such that, in use, the feeder is breakable whereby at least a part of the base portion detaches from the body portion and is received therein, and wherein the fracture strength of the neck-down feeder is no more than 5 kN.

Thus the present invention provides a feeder that is constructed as a single piece and is adapted to break upon the application of force to the sleeve, for example during the moulding and ram up operation. The arrangement of the one or more regions of weakness causes the sidewall to break at a predetermined position so as to separate at least part of the base portion from the body portion, thereby preventing uncontrolled breakage of the part of the base portion which is in contact with the mould pattern. Since pressure will always be applied during mould formation towards the mould plate, the body portion of the feeder moves towards the mould plate upon breakage, the detached part of the base portion remaining stationary since it is in contact with the mould plate.

The feeder of the present invention is designed to break when pressure is applied to the feeder during conventional moulding processes. It is therefore unlike the sleeves used in high-pressure moulding systems, such as those described in EP1775045 and DE 20 2007 005 575 U1. Such sleeves are designed to withstand high pressures to avoid substantial breakage of the sidewall in use. They are therefore made from high-density materials and typically have a crush strength in excess of 20 kN.

In some embodiments, the one or more regions of weakness are situated at least partially in the base portion of the feeder. In some embodiments, all of the regions of weakness present in the sidewall are situated entirely in the base portion of the feeder.

The provision of a one-piece feeder, wherein the base portion is integral with and detachable from the body portion, is advantageous over known two-part telescoping sleeves since it is simpler and cheaper to construct. A one-piece feeder also avoids the requirement for holding tabs that break off during compression and contaminate the moulding sand.

It will be understood that the amount of pressure and the force required to cause the sidewall to break, causing the base portion to separate from the body portion and the body portion to move towards the mould plate and receive the base portion, will be influenced by a number of factors, including the material of manufacture of the feeder and the shape and thickness of the sidewall, particularly in the region(s) of weakness. It will be equally understood that individual feeders will be designed according to the intended application, the anticipated pressures involved and the feeder size requirements.

In some embodiments, the fracture strength (i.e. the force required to initiate breakage of the sidewall) is no more than 5 kN, no more than 3 kN or no more than 1.5 kN. It will be understood that the fracture strength will always be less than the crush strength of the feeder.

By virtue of the one or more regions of reduced thickness, the feeder of the present invention is adapted to break, during use, into substantially two parts. In some embodiments, these two parts together comprise at least 90%, at least 95%, at least 98% or at least 99% of the feeder. The amount of feeder material that falls into the moulding sand upon fracture of the feeder sidewall is thereby minimised.

In some embodiments of the invention, the body portion of the feeder has a generally cylindrical shape, the external peripheral surface of the body portion having a substantially circular cross-section centred on the longitudinal axis of the sleeve and thus comprising an external circumferential surface. Alternatively the feeder may be generally oval or obround. The cross-section of the external peripheral surface of the body portion may vary along the longitudinal axis of the sleeve or alternatively the body portion may have a substantially constant external peripheral surface cross-section. The base portion of the feeder may be substantially frustoconical, the area of the cross-section of the base portion decreasing distally from the body portion.

It will be understood that the interior angle between the tapered sidewall of the base portion and the longitudinal axis of the feeder will vary according to the intended application and requirements. If the angle is too small, it will result in a long base portion and have a less uniform fracture. If the angle is too large, it will be more difficult for the mixed sand to flow and be compacted under and around the base portion on moulding.

In one series of embodiments, the interior angle between the tapered sidewall of the base portion and the longitudinal axis of the feeder is from 15 to 50 degrees, from 20 to 40 degrees or from 25 to 30 degrees.

In an embodiment, the or each region of weakness in the sidewall is provided by a region of reduced thickness. For example, the thickness of the sidewall in the one or more regions of weakness may be less than 70%, less than 60%, less than 50%; less than 40% or even less than 30% of the thickness of the remainder of the sidewall of the body portion and/or the base portion (or where the sidewall thickness varies the comparison being with the average thickness).

The appropriate thickness of the sidewall at the or each region of weakness will at least in part depend on the crush strength of the sleeve. For example very strong sleeves may require the sidewall to be relatively thin in the region of weakness for breakage to occur at moulding pressures.

In an embodiment, the region of weakness is constituted by a band of reduced thickness that extends around the entire circumference of the sidewall.

In some embodiments, the region of reduced thickness is provided by a groove, channel or one or more cut-outs in the sidewall. The groove, channel or cut-out(s) may be provided in an internal or an external surface of the sidewall, or both. The groove, channel or cut-out(s) may extend around the entire circumference of the sidewall. In some embodiments, a single groove, channel or cut-out may be provided in the sidewall. In other embodiments, two or more grooves, channels or cut-outs may be provided. The groove, channel or cut-out(s) may be situated at least partially in the base portion of the feeder, for example at the boundary between the base portion and the body portion. Alternatively, the groove, channel or cut-out(s) may be situated entirely in the base portion.

It will be understood that, apart from the one or more regions of weakness, the sidewall may be the substantially the same thickness in all parts of the feeder. Alternatively, the sidewall of the base portion may have a different thickness to that of the body portion. In some embodiments, the thickness of the sidewall of the base portion is greater than that of the body portion or vice versa.

The region of weakness is thus arranged to provide predictable and consistent breakage of the feeder when placed under pressure during conventional moulding processes, so that the feeder fractures into substantially two pieces in such a way that enables one of the parts to be received within the other.

The feeder of the present invention may be formed from or it may comprise any refractory insulating and/or exothermic material or composition from which known feeders may be formed; the skilled person will be able to select the appropriate materials for each particular requirement. The nature of the feeder is not particularly limited and it may be for example insulating, exothermic or a combination of both. Typically a feeder is made from a mixture of refractory fillers (e.g. fibres, hollow microspheres and/or particulate materials) and binders. An exothermic feeder further requires a fuel (usually aluminium or aluminium alloy) and usually initiators/sensitisers. Additionally, the feeder may be formed by any of the known methods of forming feeders, for example by vacuum forming a slurry of the sleeve material around a former and inside an outer mould, followed by heating of the sleeve to remove the water and to harden or cure the material. Alternatively, the sleeve may be formed by ramming or blowing the material in a core box (core shot method), and curing the sleeve via the passage of a reactive gas or catalyst through the sleeve to cure the binder, or via application of heat by using a heated core box, or by removing the sleeve and beading in an oven. Suitable feeder compositions include for example those sold by Foseco under the trade name KALMIN and KALMINEX, made by both slurry and core-shot methods.

The density of the feeder depends on both the composition and method of manufacture. In an embodiment, the density of the feeder is no more than 1.5 g $cm^{-3}$, no more than 1.0 g $cm^{-3}$ or no more than 0.7 g $cm^{-3}$. In an embodiment, the density of the feeder is from 0.8 to 1.0 g $cm^{-3}$ or from 0.5 to 0.7 g $cm^{-3}$.

In an embodiment, the unitary neck down feeder has an open top. In certain applications, the feeder may further comprise a lid or cover to prevent moulding sand falling into the feeder and casting cavity during moulding. The lid may be made either from the same material as the feeder of a different composition. In some embodiments, the feeder may additionally comprise a moulding pin, an end of which is received within a central bore that extends partially through the lid (i.e. a blind bore) or completely through the lid to the top surface thereof. During mould formation, when pressure causes the body portion of the feeder to move towards the mould plate upon breakage, the moulding pin passes through the central bore (piercing the top surface of the lid in the case of a blind bore), and ensures that the body portion of the feeder moves towards the moulding plate in a uniform direction without deviating from the longitudinal axis. This ensures that the base portion remains fully in contact with the mould plate and that sand is uniformly compacted under the body portion.

BRIEF DESCRIPTION OF THE DRAWINGS

The invention will now be described, by way of example, with reference to the accompanying drawings in which.

DETAILED DESCRIPTION OF THE INVENTION

Figure 1:
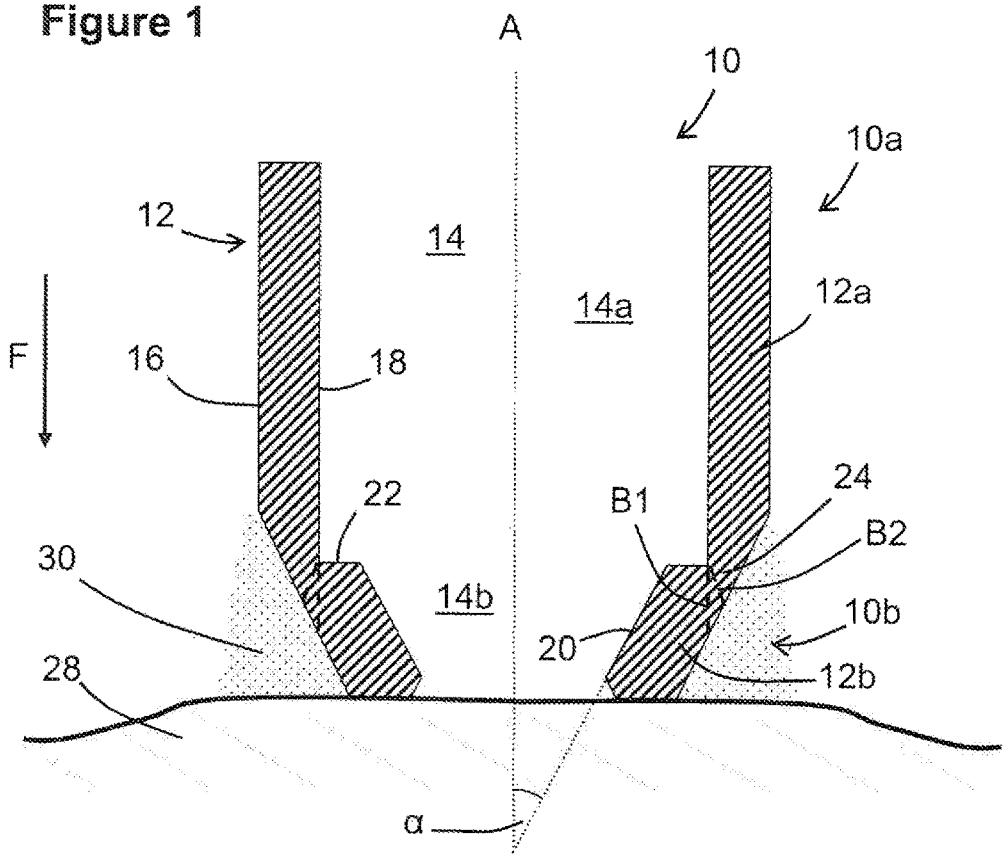
FIG. 1 shows, schematically, a cross-section of a feeder in accordance with an embodiment of the present invention.

FIG. 1 shows a feeder 10 mounted on a moulding pattern plate 28 and comprising a continuous sidewall 12 which defines a cavity 14 for receiving molten metal. Although the sidewall 12 is continuous it may be considered to comprise two parts; a generally tubular upper sidewall 12*a* of circular cross section, which defines a body portion 10*a*, and a generally frustoconical lower sidewall 12*b*, which defines the base portion 10*b*. In the embodiment shown the thickness of the lower sidewall 12*b* is generally greater than of the thickness of the upper sidewall 12*a*.

The sidewall 12 has an outer surface 16 which extends parallel to the longitudinal axis A of the feeder 10 from the top of the body portion 10*a* along most of its length and then tapers inwardly from a region close to the bottom end of the body portion 10*a* towards the longitudinal axis A of the feeder 10 to the bottom end of the base portion 10*b*.

The upper sidewall 12*a* has an inner surface 18 which is parallel to the longitudinal axis A of the sleeve 10 thereby defining a cylindrical cavity region 14*a*. It will be understood therefore that most of the upper sidewall 12*a* is of constant thickness with a (external) taper at its bottom end.

The lower sidewall 12*b* has an inner surface 20 which is mostly parallel to the tapered portion of the outer surface 16, thereby defining a frustoconical cavity region 14*b*, but is flared at the bottom of the base portion to define a restriction in the lower cavity region 14*b*. In the embodiment shown, the interior angle $\alpha$ between the inner surface 20 and the longitudinal axis A of the feeder is 27°. After casting, this region results in a notch being formed in the residual metal in the feeder and facilitates knock-off.

The upper extent of the base portion 10*b* is defined by an annular surface 22 which interconnects the lower end of the inner surface 18 of the upper sidewall region 12*a* and the upper end of the inner surface 20 of the base portion 10*b*. A right angle is defined between the annular surface 22 and the inner surface 18.

Figure 2:
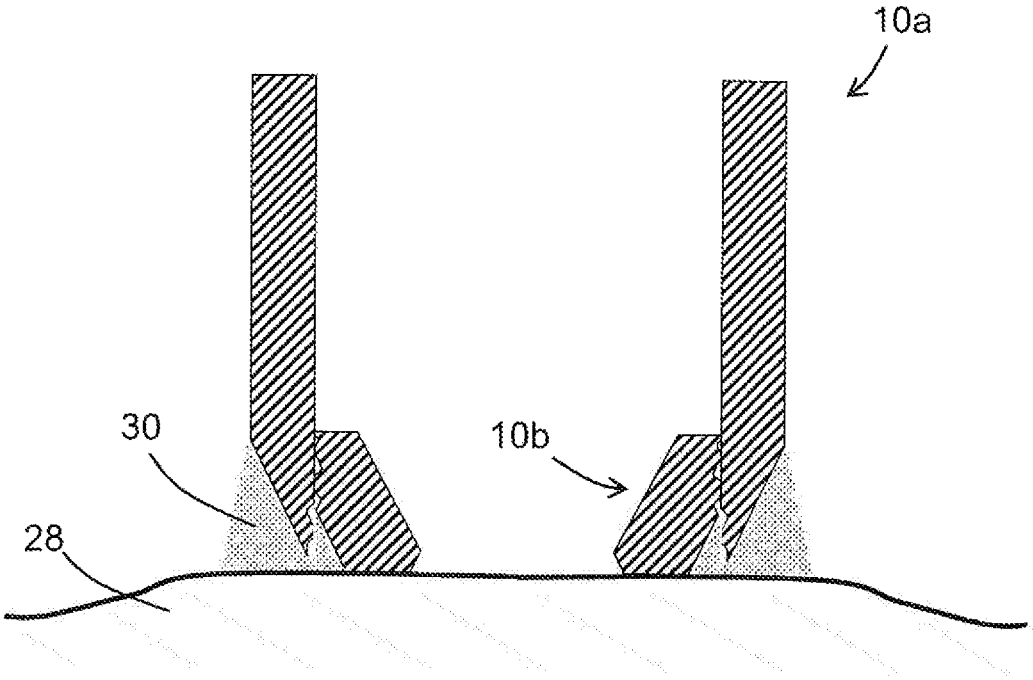
FIG. 2 shows, schematically, a cross-section of the feeder of FIG. 1 after the application of pressure and fracture of the feeder.

It will be understood that the above configuration results in the sidewall 12 having a region or band of significantly reduced thickness 24. This region 24 extends around the entire circumference of the feeder 10. In the embodiment shown, the thickness of this region 24, at its narrowest point, is reduced to approximately 40% of the thickness of the upper sidewall 12*a*. The region of reduced thickness 24 provides an area of weakness such that when a force is applied to the feeder 10 in the direction of the arrow F, the sidewall 12 breaks and severs the base portion 10*b* from the body portion 10*a*. The configuration of the sidewall 12 around the region of weakness 24 results in the formation of a substantially vertical fracture which is approximately parallel to the direction of the applied force, as indicated by the section defined by dotted lines B1 and B2. Vertical breakage of the feeder 10 results in detachment of a substantial part of the base portion 10*b* which has an external diameter no greater than the internal diameter of the upper cylindrical cavity 14*a* of the body portion 10*a*. Therefore, upon the application of further pressure to the feeder 10, that part of the base portion 10*b* is received within the cylindrical cavity 14*a* of the body portion 10*a*, as the latter moves towards the mould plate, as shown in FIG. 2. As the body portion 10*a* moves down in the direction of the force applied, the mixed sand 30 in the area under the taper and above the mould pattern 28 is further compressed and compacted.

Figure 3:
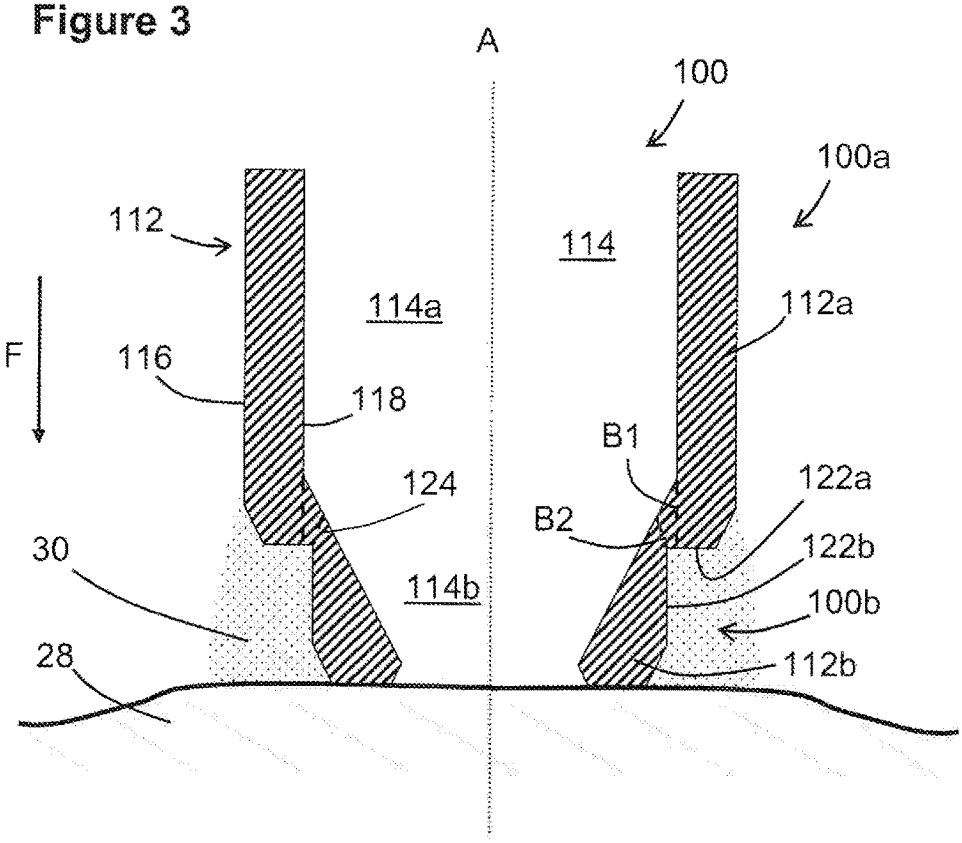
FIG. 3 shows, schematically, a cross-section of a feeder in accordance with another embodiment of the present invention.

FIG. 3 shows another embodiment of a feeder 100 comprising a continuous sidewall 112 which defines a cavity 114. As in the embodiment shown in FIG. 1, the sidewall 112 comprises a generally tubular upper sidewall 112*a* of circular cross section, which defines a body portion 100*a*, and a generally frustoconical lower sidewall 112*b*, which defines a base portion 100*b*.

The sidewall 112 has an inner surface 118 which extends parallel to the longitudinal axis A of the feeder 100 from the top of the body portion 100*a* to the top end of the base portion 100*b*, thereby defining a cylindrical cavity region 114*a*. From the top end of the base portion 100*b*, the inner surface 118 tapers inwardly towards the longitudinal axis A of the feeder 100 to almost the bottom end of the base portion 100*b*, thereby defining a frustoconical cavity region 114*b*. The inner surface 118 is flared at the bottom of the base portion 100*b* to define a restriction in the lower cavity region 114*b*. After casting, this region results in a notch being formed in the residual metal in the feeder and facilitates knock-off.

The sidewall 112 has an outer surface 116 which extends parallel to the longitudinal axis A of the feeder 100 from the top end of the body portion 100*a* and partly into the base portion 110*b*. It will be therefore understood that the upper sidewall 112*a* is of constant thickness. From close to the top end of the base portion 100*b*, the outer surface 116 tapers inwardly towards the longitudinal axis A of the feeder 100 to the bottom end of the base portion 100*b*. The tapered portion of the outer surface 116 is intersected by an annular surface 122*a* and a cylindrical surface 122*b*, which together define a right-angled groove or step in the lower sidewall 112*b*.

The groove in the outer surface 116 of the lower sidewall 112*b* results in a region or band of significantly reduced thickness 124 in the base portion, near to the junction with the body portion. This band of reduced thickness 124 extends around the entire circumference of the feeder 100. As in the embodiment of FIG. 1, this region of reduced thickness 124 provides an area of weakness such that when a force is applied to the feeder 100 in the direction of the arrow F, the lower sidewall 112*b* breaks and severs across the section bordered between the dotted lines B1 and B2. Once again, the vertical breakage of the feeder 100 results in detachment of a substantial part of the base portion 100*b* which is then received within the cylindrical cavity 114*a* of the body portion 100*a*, as the latter moves in the direction of the applied force F. The body portion 100*a*, by having an annular surface 122*a* at its base allows for good compression and compaction of the mixed sand 30 above the mould pattern 28.

Figure 4:
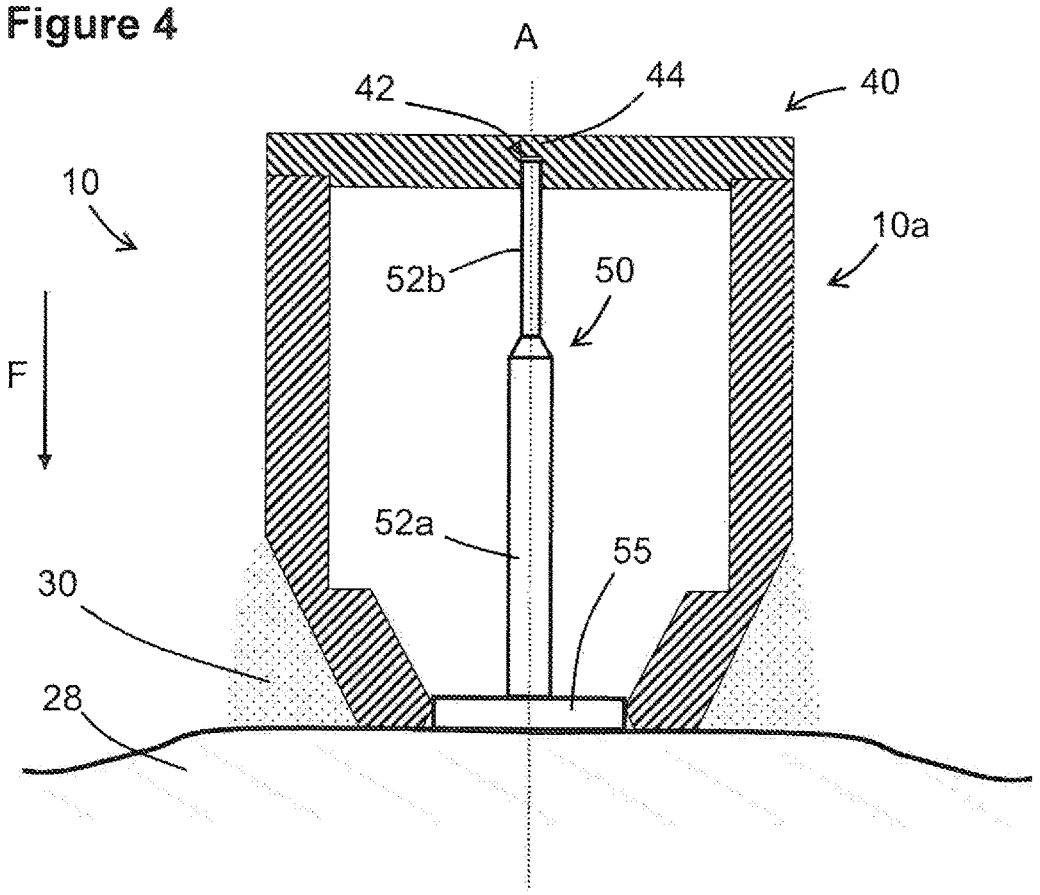
FIG. 4 shows, schematically, a cross-section of the feeder of FIG. 1 as used in conjunction with a lid and a moulding pin.

FIG. 4 shows a feeder 10 having a lid 40. The lid 40 has a recess or blind bore 42 that accommodates a support pin 50, which is used to hold the feeder 40 in position on the moulding pattern 28 before and during the moulding operation. The provision of the recess 42 in the lid 40 results in the lid having a thin section 44.

The support pin has a body 52*a* and a narrower top portion 52*b*, both of which are generally cylindrical. The body 52*a* has a screw thread (not shown) at its base which secures the body 52*a* in position on a boss 55, which in turn is positioned on the pattern plate 28. When pressure is applied to the top of the feeder 10 and the lid 40 in the direction of the arrow F, the feeder body 10*a* and the lid 40 move downwardly in the direction of the mould pattern 28, parallel to and without deviation from the longitudinal axis A. This movement causes the top portion 52*b* of the pin 52 to travel through the recess 42 and pierce the thin section 44 of the lid 40. In addition to preventing moulding sand from falling into the feeder and casting cavity during moulding, the piercing of the lid 40 creates a vent that allows mould gasses generated on casting to be readily released.

EXAMPLE

Figure 5:
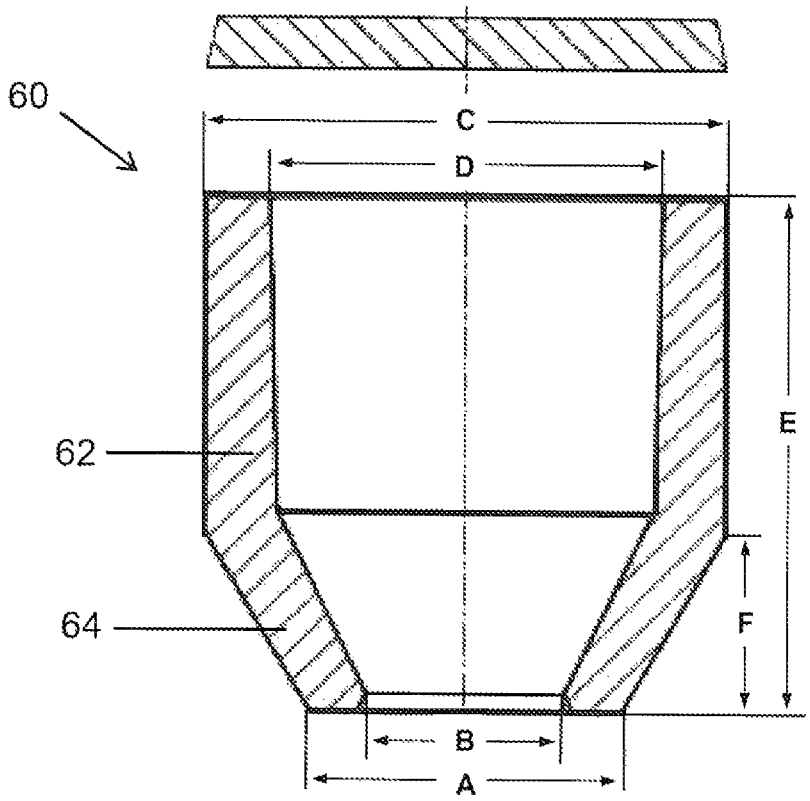
FIG. 5 shows, schematically, a cross-section of feeder prior to modification to provide a feeder in accordance with an embodiment of the present invention.

Feeders 60 (designated "ZTA1"), as shown in FIG. 5, having a tubular body portion 62 integrally formed with a frustoconical base portion 64 were prepared from KALMINEX exothermic slurry using conventional vacuum forming techniques. The dimensions of the feeders are shown in Table 1. At the junction between the base and the body portions, the interior sidewall was ground down by 6 or 12 mm to provide regions of reduced thickness,

TABLE 1

| | Nominal dimensions (mm) | | | | | | Vol. |
|---|---|---|---|---|---|---|---|
| Feeder | A | B | C | D | E | F | ($dm^3$) |
| ZTA1 | 69 | 38 | 100 | 78 | 100 | 27 | 0.41 |

A standard compression test of the modified ZTA1 feeders was carried out. The results are shown in Table 2. For comparison, the fracture strengths of different types of feeders supplied by the Applicant for use in high pressure moulding lines are also shown.

TABLE 2

| Feeder | Average strength (kN) |
|---|---|
| ZTA1 (6 mm) | 1.87[1] |
| ZTA1 (12 mm) | 0.93[1] |
| Comparative feeder X | 23-34 |
| Comparative feeder Y | 33-40 |
| Comparative feeder Z | >50 |

[1]The value shown for the ZTA1 feeders is the fracture strength, i.e. the force required for the feeder to break into two predetermined portions, one portion being received inside the other. It will be appreciated that the comparative feeders do not have a 'fracture' strength since these feeders do not fracture into two defined portions but instead are broken into many fragments when sufficient force is applied. The strengths of the comparative feeders are therefore the 'crush' strengths.

When placed under compression, the ZTA1 feeders collapsed such that the base portion of the feeder was detached from and received within the body of the feeder. In each test carried out the feeder fractured around its circumference in the region of reduced thickness, as expected. A clean break was achieved in each case, releasing only a few small particles of feeder material. The fracture strength of the ZTA1 feeders was found to be less than 3 kN. As shown in Table 2, the crush strengths of the comparative feeders for use in high pressure moulding lines were found to be significantly higher.

The invention claimed is:

1. A neck-down feeder of unitary construction for use in metal casting, comprising a body portion integrally formed at a first end thereof with a tapered base portion for mounting on a mould pattern, the body portion and the base portion being defined by a continuous sidewall having one or more regions of reduced thickness arranged such that, under the application of force in the direction of the mould pattern, the feeder is breakable whereby at least a part of the base portion detaches from the body portion and is received therein, and wherein the force required to initiate breakage in the one or more regions of reduced thickness is no more than 5 kN.

2. The feeder according to claim 1, wherein the one or more regions of reduced thickness in the sidewall are situated at least partially in the base portion of the feeder.

3. The feeder according to claim 2, wherein the one or more regions of reduced thickness in the sidewall are situated entirely in the base portion of the feeder.

4. The feeder according to claim 1, wherein the force required to initiate breakage in the one or more regions of reduced thickness is no more than 3 kN.

5. The feeder according to claim 1, wherein the or each region of reduced thickness is constituted by a continuous band of reduced thickness that extends around the entire circumference of the sidewall.

6. The feeder according to claim 1, wherein the thickness of the sidewall in the or each region of reduced thickness is less than 70% of the thickness of the remainder of the sidewall of the body portion and/or the base portion.

7. The feeder according to claim 6, wherein the thickness of the sidewall in the or each region of weakness is less than 50% of the thickness of the remainder of the sidewall of the body portion and/or the base portion.

8. The feeder according to claim 1, wherein the region of reduced thickness is provided by a groove, channel or one or more cut-outs in the sidewall.

9. The feeder according to claim 1, wherein the one or more regions of reduced thickness are arranged such that, in use, the feeder is breakable into substantially two pieces.

10. The feeder according to claim 1, further comprising a lid.

11. The feeder according to claim 10, further comprising a moulding pin, an end of which is received within a central bore that extends partially or entirely through the lid.

12. The feeder according to claim 1, wherein the feeder has a density of from 0.8 to 1.0 g $cm^{-3}$.

13. The feeder according to claim 1, wherein the feeder comprises an exothermic composition.

14. A feeder system comprising the feeder of claim 1 and a breaker core.

* * * * *